United States Patent [19]

French

[11] 3,944,455

[45] Mar. 16, 1976

[54] LABELLING SYSTEM AND CASSETTE LABEL APPLICATOR USABLE THEREWITH

[75] Inventor: John B. French, Hacienda Heights, Calif.

[73] Assignee: Compac Corporation, Netcong, N.J.

[22] Filed: Sept. 27, 1973

[21] Appl. No.: 401,161

[52] U.S. Cl. ..... 156/361; 156/542; 156/556; 156/557; 156/584; 156/DIG. 26; 156/DIG. 33; 156/DIG. 45

[51] Int. Cl.[2].... B65C 9/42; B65C 9/04; B65C 9/18; B65H 25/00

[58] Field of Search ..... 156/542, 361, 584, 540, 156/556, 557, 363, 364, DIG. 11, 285, DIG. 26, DIG. 33, DIG. 41, DIG. 42, DIG. 45

[56] References Cited

UNITED STATES PATENTS

| | | | |
|---|---|---|---|
| 3,036,941 | 5/1962 | Sigmon | 156/542 X |
| 3,093,528 | 6/1963 | Reich | 156/285 |
| 3,329,550 | 7/1967 | Kucheck | 156/285 |
| 3,405,021 | 10/1968 | Marano | 156/542 X |
| 3,668,047 | 6/1972 | Heller | 156/584 X |
| 3,793,114 | 2/1974 | Thomas | 156/542 X |
| 3,833,448 | 9/1974 | Gates et al. | 156/542 X |

*Primary Examiner*—William A. Powell
*Assistant Examiner*—Thomas Bokan
*Attorney, Agent, or Firm*—Gordon L. Peterson

[57] ABSTRACT

A labelling system for labelling articles comprising a cassette label applicator having a supply of labels and a conveyor for moving articles past the label applicator where the label applicator applies the label to the articles as they are moved past the label applicator and the conveyor is adapted so the cassette label applicator may be replaced with another cassette label applicator after the supply of labels of the original cassette label applicator becomes at least substantially exhausted.

13 Claims, 7 Drawing Figures

LABELLING SYSTEM AND CASSETTE LABEL APPLICATOR USABLE THEREWITH

BACKGROUND OF THE INVENTION

Many articles such as containers for products and/or the products themselves must bear a label providing pricing information, product identification, etc. The labels are typically supplied on an elongated backing strip with the labels being adhesively secured to the backing strip. The labelling function is carried out by a label applicator which removes the labels and adhesively applies them to the articles as the articles are moved by a conveyor past the label applicator.

A label applicator typically includes a rotatable supply reel and a takeup reel. The backing strip is wound on the supply reel and extends over and through various guiding devices, such as rollers, to the takeup reel. A peeling bar is located intermediate the reels for removing the labels from the backing strip. When the label applicator is in use, the backing member is driven from the supply reel to the takeup reel. While the backing strip is moving, the labels are removed by the peeling bar and applied to the articles.

This type of label applicator is quite satisfactory in many respects. Unfortunately, however, the supply of labels is not endless. Thus, when the supply of labels initially wound on the supply reel is exhausted, the label applicator and the associated conveyor must be shut down. A workman must then replace the supply reel with another supply reel having a supply of labels wound thereon. The takeup reel must also be replaced with an empty takeup reel. The free end of the backing strip is "threaded" through the various guiding devices and around the peeling bar to the takeup reel. This threading operation is similar to threading movie film in a movie projector.

The replacement of the reels and the threading operation consume a substantial period of time. This is very undersirable in that the entire labelling function is shut down during this period.

SUMMARY OF THE INVENTION

The present invention solves this problem by providing for rapid replacement of the entire label applicator when its supply of labels is exhausted. To accomplish this a supply of labels is preloaded into a second applicator. When the supply of labels in a first label applicator is exhausted, it can be rapidly replaced with the second label applicator so that the labelling function can continue. The entire label applicator can be replaced much more quickly than replacing reels and rethreading of the backing strip.

After the first label applicator has been removed from the labelling line, it is reloaded with labels. Accordingly, the labelling line is not shut down during the time that the label supply is being replenished in the first label applicator. The net effect of label applicator replacement in lieu of reel replacement and rethreading is that the labelling line is shut down only a very brief period, rather than the much longer period of time required with prior art practices.

To facilitate rapid replacement, each of the label applicators is preferably in the form of a cassette. As such, the label applicator can be quickly inserted into, and removed from, a support. The label applicator is mounted on the support by appropriate releasable couplings such as quick disconnect couplings. Locator means automatically locate the label applicator with respect to the articles so that it can apply labels to the articles when it is releasably mounted on the support.

Although the concept of replaceable label applicators is applicable to label applicators of different constructions, the present invention facilitates such replacement by providing a small, lightweight label applicator which can be installed and removed very quickly. In order to make the label applicator small and lightweight, the present invention teaches that components characteristically included in the label applicator can be mounted on a support and not form a part of the label applicator. For example, a label applicator typically includes a power source such as an electric motor for driving the various components thereof. With the present invention, the motor is mounted on the support and does not form a portion of the label applicator. Releasable means drivingly interconnects the motor and the labels carried by the label applicator. The releasable means allows the label applicator to be removed without removing the motor. As the motor does not form a portion of the label applicator, the motor controls also need not form a portion of the label applicator.

Label applicators also typically include plungers or means for blowing the label from the applicator to the article. The label applicator of this invention is further simplified and reduced in weight in that no means are provided on the label applicator for transferring the label to the article. Rather, the label to be applied is held by the label applicator, and the article is forced against the label by an apparatus which forms a portion of the article conveying system. If desired, this apparatus for forcing the article against the label can be omitted.

The present invention employs a simplified device for feeding the labels. The feeding device may include a pin feed mechanism adapted to cooperate with holes in the backing strip. The feed mechanism is driven by the drive motor and may form a portion of the label applicator. A pin feed mechanism of this type is adapted to work on a ratchet or one-way clutch type principle. Accordingly, the motor may provide linear rather than rotary motion. As such the motor may include a solenoid or a fluid-actuated cylinder of simple, inexpensive construction.

The elimination of components from the label applicator as noted above makes the label applicator considerably less expensive. Another advantage of this invention is that a malfunctioning label applicator can be quickly replaced rather than repaired while it is on the production line. This minimizes the downtime of the production line as a result of the malfunctioning label applicator.

Another feature of the invention is that it is adapted to label articles of irregular size and/or shape. This can advantageously be accomplished by utilizing resilient rotatable means for urging the articles against the label applicator at the appropriate location to contact the adhesive side of the label. Because this means is rotatable it provides a power source for driving the article against the label applicator. The resilient nature of the rotatable means allows it to accommodate articles of different sizes and shapes.

Although the label applicator of this invention can have various different spatial orientations, it is adapted for being located in substantial part below the conveyor for the articles. To facilitate removal of the label applicator, the section of the conveyor immediately above the label applicator can be mounted for pivotal movement to allow this section of the conveyor to be swung upwardly. If gravity feed is being employed for the articles, the conveyor may include a chute.

The invention can best be understood by reference to the following description taken in connection with the accompanying drawings.

DESCRIPTION OF THE PREFERRED EMBODIMENTS

Figure 1:
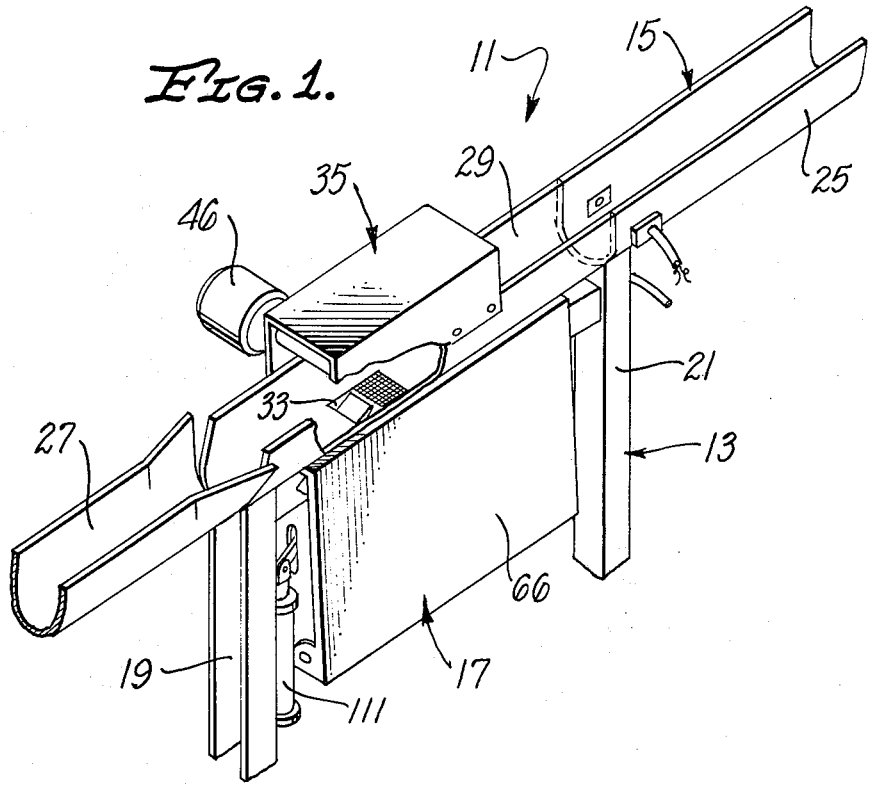
FIG. 1 is a fragmentary, perspective view, with parts broken away, of a labelling system constructed in accordance with the teachings of this invention.

FIG. 1 shows a labelling system 11 which generally includes a support 13, a conveyor 15 mounted on and supported by the support, and a label applicator 17 releasably mounted on the support. The support 13 may be of any size or configuration suitable for supporting the label applicator 17. Accordingly, the construction of the support 13 can vary widely, and the construction illustrated is purely illustrative.

In the embodiment illustrated, the support 13 includes a pair of horizontally spaced, parallel legs 19 and 21. The lower ends of the legs 19 and 21 can be supported by a base (not shown) or a suitable floor structure. Each of the legs 19 and 21 is formed from a metal channel. The channels forming the legs 19 and 21 open in opposite directions. The support 13 may also include additional legs 19 and 21 (not shown) or other structure for supporting the conveyor 15.

The function of the conveyor 15 is to convey articles 23 past the label applicator 17. Any device suitable for this purpose can be employed as the conveyor. Accordingly, the particular construction of the conveyor 15 shown and described herein is merely illustrative. Although the conveyor 15 could include a movable belt for transporting the articles 23, in the embodiment illustrated, it includes an inclined chute. The conveyor 15 includes fixed chute sections 25 and 27 appropriately attached to the legs 19 and 21 respectively, and a hinged or pivotable chute section 29. Each of the chute sections, 25, 27, and 29, is in the form of an upwardly opening metal trough. The conveyor 15 may include as many of the sections 25, 27, and 29 as is necessary to adequately convey and label the articles 23.

The hinged section 29 is connected to the section 27 by a hinge 31 and is supported by the legs 19 and 21. The hinged section 29 also has a longitudinally extending slot 33 in the bottom wall thereof.

Figure 3:
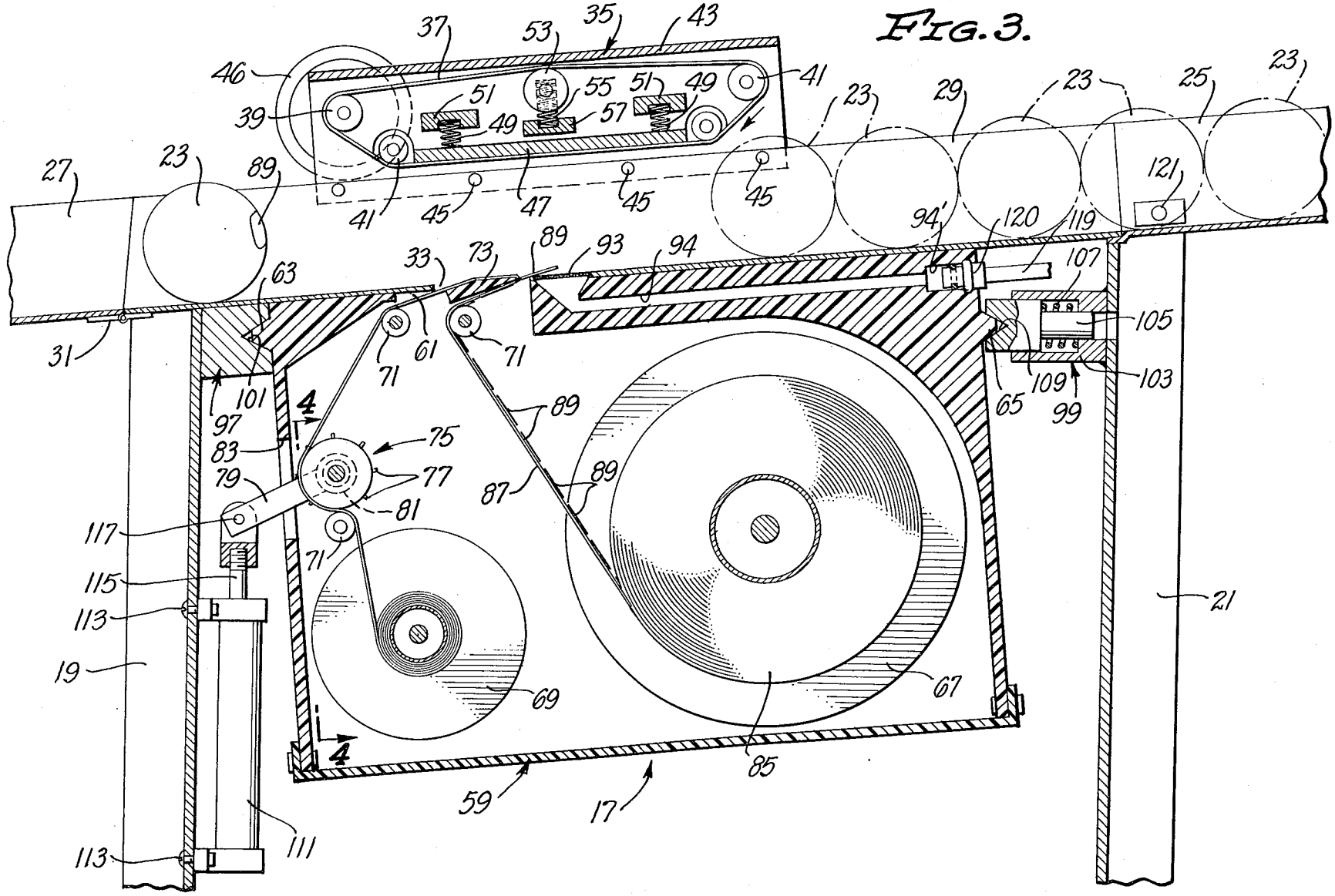
FIG. 3 is an enlarged fragmentary sectional view of a portion of the labelling system.
Figure 3A:
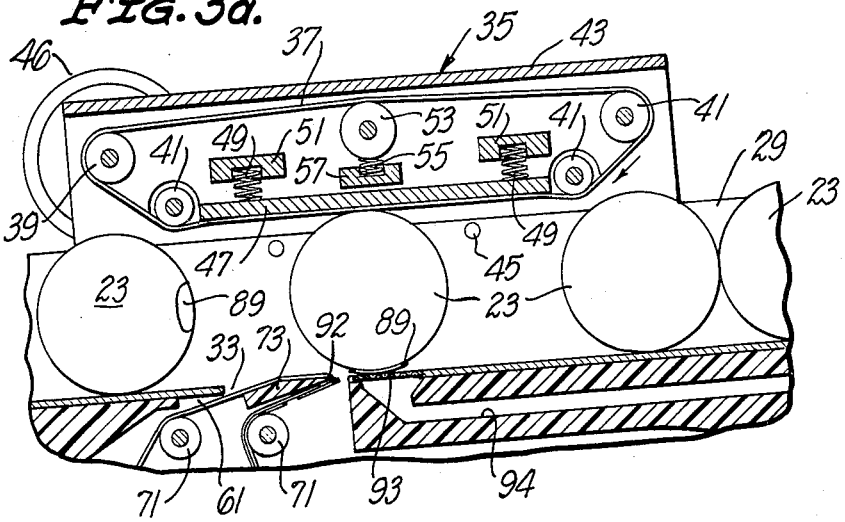
FIG. 3*a* is a fragmentary view showing a portion of the structure depicted in FIG. 3 and illustrating the operation of the labelling system.

The conveyor 15 includes a powered unit 35 suitably mounted on the hinged section 29. The powered unit, which can best be seen in FIG. 3, is located above the slot 33. The powered unit 35 includes an endless belt 37, a drive roller 39, and a plurality of idler rollers 41. The rollers 39 and 41 are mounted on a housing 43. The housing 43 is in the form of an open-ended, downwardly opening channel. The housing 43 is attached to the hinged section 29 in any suitable manner such as by fasteners 45. The drive roller 39 is driven by a motor 46 mounted on the housing 43.

A plate 47 is urged downwardly against the inner face of the lower portion of the endless belt 37 by a plurality of springs 49. The other ends of the springs 47 bear against brackets 51 suitably attached to the housing 43. Similarly, an idler roller 53 is resiliently urged against the inner face of the upper side of the endless belt 37 by a spring 55. The other end of the spring 55 bears against a bracket 57 which is suitably mounted on the housing 43. As viewed in FIG. 3, the left end of the plate 47 is directly above the slot 43.

The label applicator 17 is, in effect, a cassette. The label applicator 17 includes a supporting structure in the form of a housing 59 which is adapted to substantially completely enclose the components of the label applicator. The housing 59 can be formed of any suitable material such as metal or plastic and, in the embodiment illustrated, is constructed of plastic. In the embodiment illustrated, the housing 59 is a generally rectangular enclosure having an opening 61 in the top wall thereof in substantial registry with the slot 33. Lugs 63 and 65 are formed integrally with the housing and project therefrom in opposite directions at the opposite ends of the housing 59. The housing 59 includes a hinged side panel 66 (FIG. 1) which can be swung open to provide access to the interior of the housing.

A supply reel 67 and a takeup reel 69 are rotatably mounted within the housing 59. Similarly, a plurality of idler rollers 71 (three being illustrated) are rotatably mounted within the housing 59. A peeling bar 73, which may be of conventional construction, is mounted on the housing 59 within the opening 61. A drive means in the form of a pin feed mechanism 75 is mounted within the housing 59 for rotational movement. Pin feeding mechanisms of this type are known, and accordingly, the details of this mechanism are not shown herein. The pin feed mechanism 75 includes a plurality of pins 77 arranged in two side-by-side rows (FIG. 4) on a common hub for rotation, a movable member or actuating arm 79, and a suitable one-way clutch 81. The actuating arm 79 is coupled to the pins 77 through the one-way clutch 81 so that the actuating lever 79 drives the pins 77 only when the lever is moving in the counterclockwise direction as viewed in FIG. 3. When the actuating arm 79 is moved in the clockwise direction as viewed in FIG. 3, the clutch 81 is disengaged and the pins 77 are not driven. As shown in FIG. 3, the actuating lever 79 projects laterally outwardly through a slot 83 in the housing 59, and terminates outside of the housing.

Figure 5:
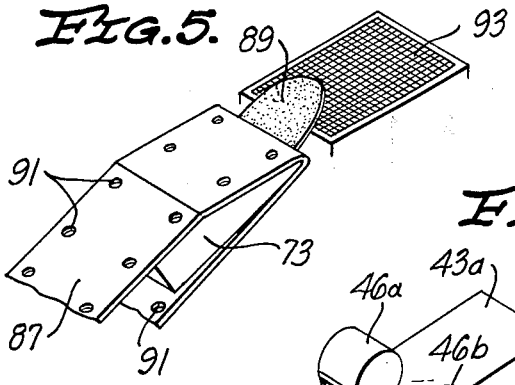
FIG. 5 is a fragmentary perspective view illustrating how labels are peeled off of the backing strip by the peeling bar.

A label supply 85 is mounted on the supply reel 67. The label supply includes an elongated backing strip 87 and a plurality of labels 89 adhesively secured to the backing strip. As shown in FIG. 5, the backing strip 87 has two rows of holes or apertures 91 extending along each of its longitudinal edges.

The backing strip 87 extends from the supply reel 67 over one of the idler rollers 71, the peeling bar 73, the remaining rollers 71, and the pin feed mechanism 75 to the takeup roller 69. The two rows of pins 77 of the pin feed mechanism 75 are adapted to be received within the holes 91 of the backing strip 87. Accordingly, the pins 77 can drive the backing strip from the supply reel 67 to the takeup reel 69.

As the backing strip 87 is drawn over a forward edge 92 of the peeling bar 73, the adjacent label 89 is peeled off of the backing strip in a conventional manner. The removed label 89 is positioned at a labelling station, and is held thereon a grid 93 or other air-pervious means, with the adhesive side of the label exposed. The label 89 thus positioned on the grid 93 is retained in this position by vacuum pressure on the inner face of the grid 93. The inner face of the grid 93 communicates only with a passage 94. The passage 94, in the emodibment illustrated, is formed by a portion of the housing 59 and terminates in a socket 94' at the right end of the housing.

It is desirable to drive the takeup reel 69 so that the backing strip 87 will be wound thereon. This can advantageously be accomplished by an appropriate power takeoff from the pin feed mechanism 75 such as the type shown by way of example in FIG. 4. From FIG. 4 it can be seen that the actuating arm 79 drives the one-way clutch 81 and the one-way clutch transmits motion in only one direction to the pin feed mechanism 75. A pulley 95 is interposed between the one-way clutch 81 and the feed mechanism 75. The pulley 95 is driven in only one direction by the one-way clutch 81. The pulley 95 is drivingly coupled to a pulley 95' by an endless belt 96. The pulley 95' is coupled by a slip clutch 98 to the takeup reel 69. Accordingly, the takeup reel 69 is driven each time the pin feed mechanism 75 is driven. This mechanism is arranged so that the belt 96 tends to drive the takeup reel 69 more than is necessary to accommodate the movement of the backing strip 87. This keeps the length of the backing strip 87 between the pin feed mechanism 75 and the takeup reel 69 taut. The slip clutch 98 slips to the extent necessary to accommodate the tendency of the belt 96 to overdrive the takeup reel 69.

The label applicator 17 can be mounted on the support 13 in any manner which will provide for its quick installation and removal. In the embodiment illustrated, this is accomplished by a pair of couplings 97 and 99 suitably affixed to the legs 19 and 21 respectively. The coupling 97 is in the form of a mounting block having a groove or notch 101 therein sized and shaped to receive the lug 63 of the housing 59.

The coupling 99 includes a tubular housing 103 rigidly affixed to the leg 21, a movable mounting member 105 mounted for sliding movement in the housing 103, and a spring 107 within the housing 103 for urging the movable mounting member 105 toward the left as viewed in FIG. 3. The movable mounting member 105 has a groove or notch 109 therein sized and shaped to accommodate the lug 65. The movable mounting member 105 can be retained within the housing 103 in any suitable manner. Thus, the label applicator 17 is clampingly retained between the couplings 97 and 99.

The couplings 97 and 99 and the lugs 63 and 65 must be properly positioned so that the label applicator 17 will be in the proper position for label application. The couplings 97 and 99 serve also as locator means to locate or position the label applicator 17. Of course, locator means separate from the couplings 97 and 99 could be provided, if desired. Specifically, when the label applicator 17 is releasably mounted on the support 13 by the couplings 97 and 99, the peeling bar 73 and the grid 93 are exposed in the slot 33 and the upper surface of the label applicator 17 lies immediately below and contiguous the lower surface of the hinged section 29.

The pin feed mechanism is driven by a motor 111 which is not part of the label applicator 17. Rather, the motor 111 is mounted on the leg 19 by fasteners 113. In the embodiment illustrated, the motor 111 is a pneumatic actuator which includes a connecting rod 115, the outer end of which is releasably connected to the outer end of the actuating lever 79 by any suitable releasable means, such as a quick disconnect coupling 117. The connecting rod 115 is reciprocated by the motor 111 in a conventional manner, thereby oscillating the actuating lever 79.

The motor 111 can be virtually any type of power source. However, one advantage of this invention is that the motor 111 need not provide a rotary output characteristic of electric motors. Rather a reciprocatory output characteristic of fluid-operated actuators and solenoids can be utilized.

The only other external connection required by the label applicator 17 is a source of vacuum pressure for the inner face of the grid 93. This is provided by a conduit 119 having a quick disconnect coupling 120 received within the socket 94'. The conduit 119 may lead to a suitable vacuum source (not shown).

A variety of control systems may be utilized to control the removal of labels 89 from the backing strip 87. There are many known methods of synchronizing label removal from the backing strip with passage of an article by a labelling station. In the embodiment illustrated, the articles 23 are conveyed past the grid 93 and the label applicator 17 is operated at sufficient speed to provide a label for each of the articles.

Specifically, a detector 121 (FIG. 3) which may be, for example a simple two-state device such as a photocell or a microswitch, is mounted on the chute section 25 closely adjacent the hinged section 29. If the detector 121 is a photocell, it is in one state when an article 23 blocks the beam which it provides, and is in a second state when the article is not blocking its beam. The detector 121 provides an electrical signal for controlling an electrically responsive valve (not shown) which controls the flow of air to the pneumatic motor 111. This control is such that the motor 111 moves the connecting rod 115 through a full cycle, i.e., two strokes, each time one of the articles 23 rolls past the detector 121. In this manner, one of the labels 89 is provided for each of the articles 23.

With the label applicator 17 mounted on the support 13 as shown in FIG. 3, the labelling system 11 is ready for operation. Each time one of the articles rolls past the detector 121, the connecting rod 115 is moved downwardly to pivot the actuating lever 79 counterclockwise. This drives the pin 75 counterclockwise as viewed in FIG. 3 through the one-way clutch 81. The pins 77 of the pin feed mechanism 75 are received in the apertures 91 of the backing strip 87. Accordingly, each downward stroke of the connecting rod 115 indexes the backing strip 87 a predetermined amount.

The amount the backing strip 87 is indexed is just sufficient to allow the peeling bar 73 to remove one of the labels 89 from the backing strip and apply it to the grid 93. The vacuum pressure existing in the conduit 94 retains the removed label 89 against the outer face of the grid 93.

The takeup reel 69 is also driven each time the connecting rod 15 moves downwardly. Specifically, the takeup reel 69 is driven by the one-way clutch 81, the pulley 95, the belt 96, the pulley 95', and the slip clutch 98. The slip clutch 98 slips to prevent the takeup reel 69 from being overdriven in relation to the amount that the pin feed mechanism 75 drives the backing strip 87. The connecting rod 115 may be immediately returned to an upper position so that it will be ready for the next indexing motion when another one of the articles 23 passes by the detector 121.

Figure 4:
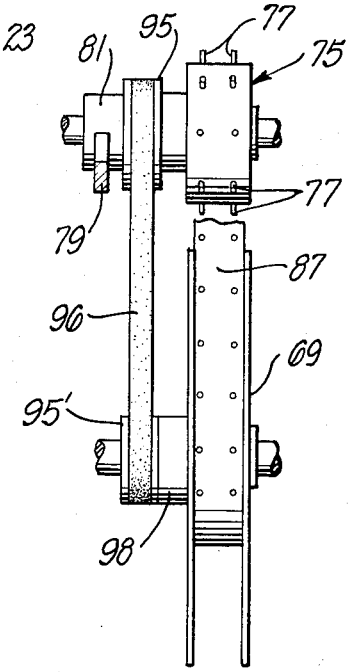
FIG. 4 is a fragmentary end elevational view taken generally along line 4—4 of FIG. 3.

The chute sections 25, 27, and 29 are inclined to the left as viewed in FIG. 3. Accordingly, the articles 23 tend to roll downwardly toward the grid 93. The belt 37 is driven at a speed which moves any article 23 engaging it faster than that article would roll down the incline of the chute section 29. Accordingly, one function of the endless belt 37 is to pick the leading article 23 and move it rapidly away from the articles 23 stacked up behind it (FIG. 4). The belt 37 moves the article over the label 89 at the grid 93. The springs 49 allow the belt 37 to accommodate articles of different sizes and configurations. This is particularly advantageous when it is desired to label fruit such as oranges. Finally, the springs 49 load the article 23 against the label on grid 93, thereby assuring good contact between the adhesive of the label and the article (FIG. 4).

Figure 2:
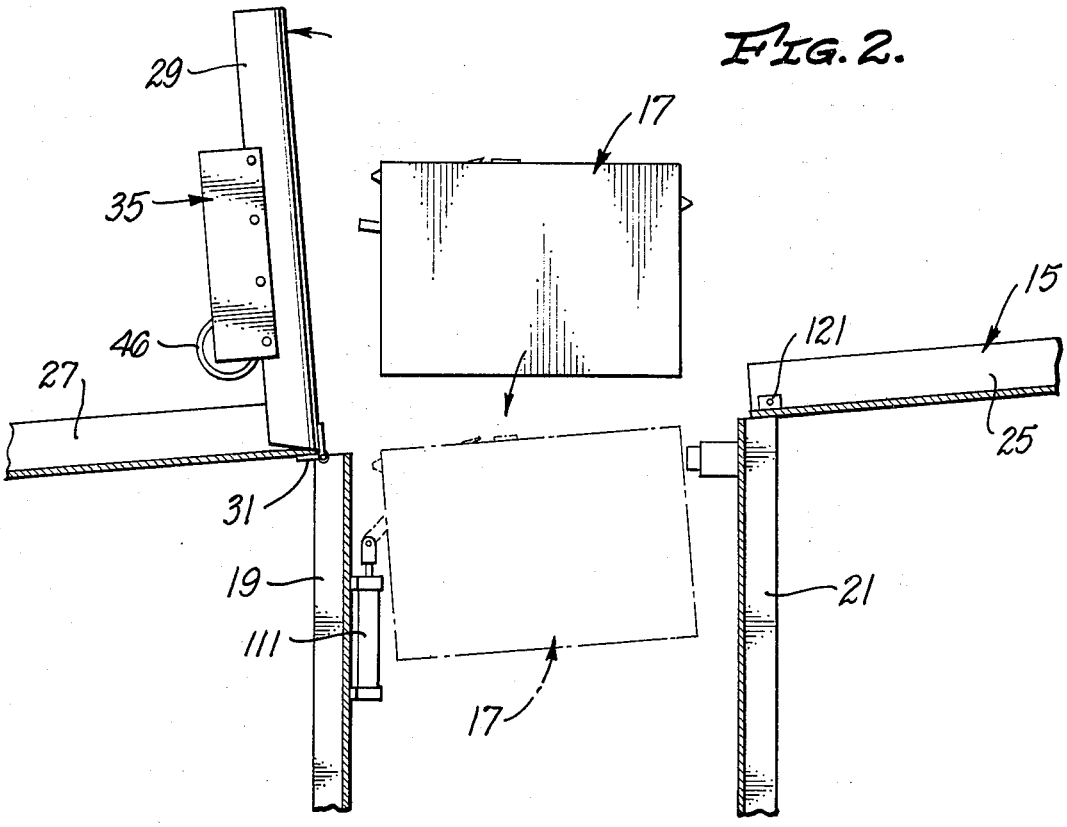
FIG. 2 is a fragmentary side elevational view partially in section of the labelling system showing how a label applicator can be inserted into or removed from the system.

When the supply of labels in the label applicator 17 becomes exhausted, or if the label applicator 17 should malfunction, the operator pivots the hinged chute section 29 upwardly to the position shown in FIG. 2. The quick disconnect couplings 117 and 120 are disconnected to separate the label applicator from the motor 111, and the conduit 119, respectively. The mounting member 105 is then moved inwardly or to the right as viewed in FIG. 3 against the biasing action of the spring 107 to permit the label applicator to be manually freed from the couplings 97 and 99. With the applicator free of the couplings 97 and 99, it can be lifted upwardly away from the remainder of the labelling system 11. Removal of the label applicator 17 does not result in the removal of the motor 111 or the powered unit 35. Another label applicator identical to the applicator 17 and having a supply of labels therein can then be installed as shown in FIG. 2. This can be accomplished in a matter of seconds. The couplings 97 and 99 and the lugs 63 and 65 automatically locate the label applicator in the position shown in FIG. 3, i.e., in position for applying the labels 89 to the articles 23.

Figure 6:
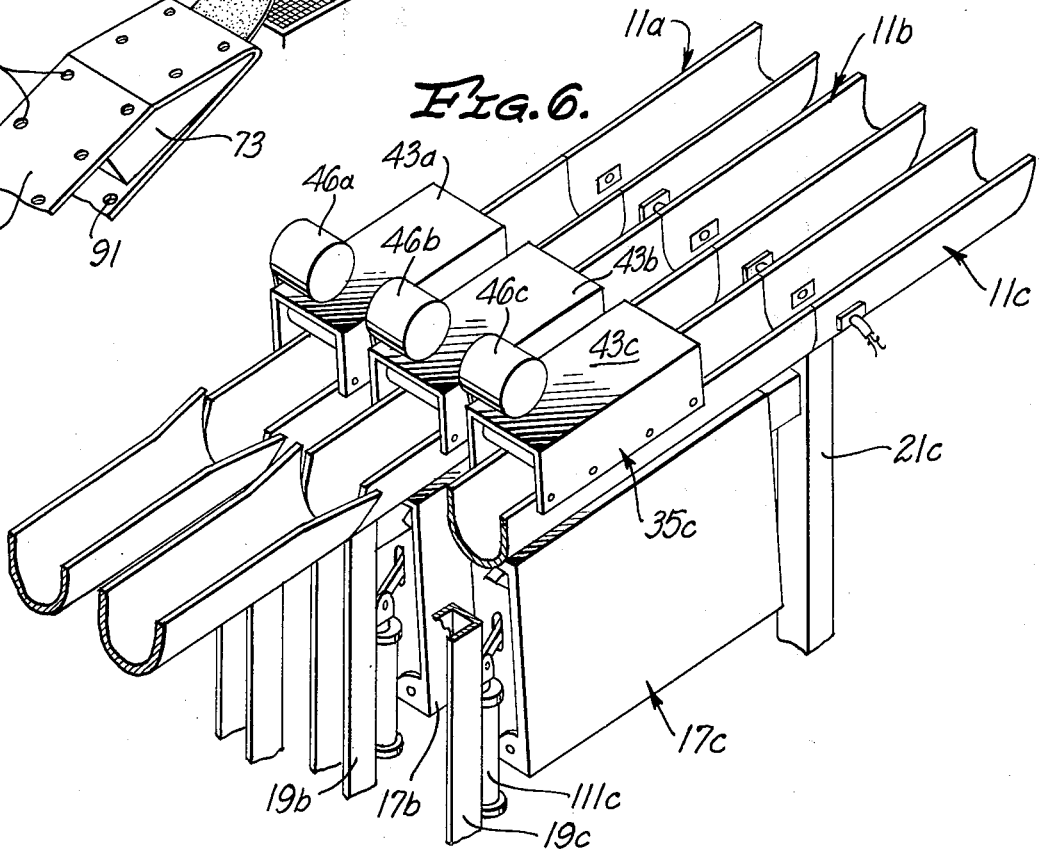
FIG. 6 is a fragmentary perspective view similar to FIG. 1 showing a labelling system including a plurality of conveyors and label applicators.

FIG. 6 shows a labelling system which includes three separate labelling systems, 11*a*, 11*b*, and 11*c*, each of which may be identical to the labelling system 11 (FIGS. 1–5) except for location of the motors 46*a*, 46*b*, and 46*c*. In FIG. 6, the motors 46*a*, 46*b*, and 46*c* are mounted on top of the housings 43*a*, 43*b*, and 43*c* respectively. The labelling systems 11*a*, 11*b*, and 11*c* which correspond to portions of the labelling system 11 are designated by corresponding reference numerals followed by the letters *a*, *b*, and *c*, respectively. The label applicators of the labelling systems 11*a*, 11*b*, and 11*c* can be operated individually or together. Because of the compact nature of the label applicators 17*a* and 17*c* and because the motors 46*a*, 46*b*, and 46*c* are mounted above their respective housings, a plurality of labelling lines can be arranged in side-by-side relationship in a relatively small space. Because the label applicators can be removed by lifting them upwardly from the supporting structure, each of the label applicators of the system shown in FIG. 6 can be removed notwithstanding the presence of label applicators on opposite sides thereof.

Although exemplary embodiments of the invention have been shown and described, many changes, modifications, and substitutions may be made by those having ordinary skill in the art without necessarily departing from the spirit and scope of this invention.

I claim:

1. A labelling system comprising:

a support;

means for conveying articles along a first path to a labelling station;

a label applicator for applying labels to the articles;

first releasable means for releasably mounting said label applicator on said support at said labelling station whereby the label applicator can apply labels to the articles conveyed through the labelling station;

said label applicator including a supporting structure and means for mounting a plurality of labels for movement along a second path relative to the supporting structure whereby the labels can be progressively moved through the labelling station and applied to the articles;

a motor;

means other than said label applicator for mounting the motor on said support; and second releasable means for drivingly interconnecting the motor and the labels so that the motor can move the labels along said second path, said first and second releasable means being releasable to allow replacement of the label applicator when its supply of labels is exhausted with a second label applicator having a supply of labels, said second label applicator being drivable by said motor through said second releasable means.

2. A labelling system as defined in claim 1 wherein said labels include adhesive, said label applicator includes means for retaining a label in the path of the articles conveyed through the labelling station with the adhesive of the label exposed so as to engage the article at the labelling station.

3. A labelling system as defined in claim 2 including resilient means mounted on said support to resiliently urge the article against the adhesive of the label retained by said label applicator, said label applicator being removable from said support by releasing said first and second releasable means and without removing said resilient means from said support.

4. A labelling system as defined in claim 1 wherein the labels are carried on a backing strip adapted to have holes therein, said second releasable means includes at least one movable pin adapted to cooperate with the holes to move the labels along said path.

5. A labelling system as defined in claim 1 including control means for controlling said motor so that the labels are moved intermittently along said path, said label applicator being removable from the support without removing said control means.

6. A labelling system as defined in claim 1 wherein said motor includes a fluid operated actuator, said second releasable means includes a movable member carried by said label applicator and means for releasably drivingly coupling said movable member to said actuator, and control means responsive to movement of articles through the labelling station for controlling said fluid operated actuator.

7. A labelling system as defined in claim 1 wherein said label applicator includes vacuum means for releasably retaining a label at the labelling station.

8. A labelling system comprising:

a support;

means for conveying articles to be labelled along a first path through a labelling station;

a label applicator for applying labels to the articles;

first releasable means for releasably mounting said label applicator on said support at said labelling station whereby the label applicator can apply labels to the articles conveyed through the labelling station, at least a substantial portion of said label applicator lying below said first path at said first path of the labelling station;

said label applicator including a supporting structure and means for mounting a plurality of labels for movement along a second path relative to the supporting structure whereby the labels can be progressively moved through the labelling station;

resilient rotatable means mounted above said labelling station for urging articles against the label applicator at said labelling station whereby the labels are applied to the articles; said first path extending between the resilient rotatable means and said substantial portion of the label applicator at the labelling station.

9. A labelling system as defined in claim 8 wherein said conveying means includes a conveyor overlying said label applicator, said conveyor including a pivotable section pivotable upwardly to provide access to the upper side of the label applicator.

10. A labelling system as defined in claim 8 wherein said conveying means includes a gravity feed section at said labelling station and said label applicator includes a supply reel having the labels wound thereon and a takeup reel, said reels lying below said conveying means at said labelling station.

11. A cassette label applicator for applying labels to articles wherein the labels are supplied on a backing strip and the label applicator is drivingly connectable to a motor, said label applicator comprising:

a supporting structure;

a supply reel mounted for rotation on the supporting structure and adapted to have the backing strip wound thereon;

a takeup reel mounted for rotation on the supporting structure, said backing strip adapted to extend from the supply reel to the takeup reel and to be wound on the takeup reel;

drive means mounted on the supporting structure for movement relative thereto and cooperable with the backing strip to move the backing strip from the supply reel to the takeup reel;

means for releasably drivingly connecting the driving means to the motor whereby the motor can drive the drive means;

means for removing the labels from the backing strip as the backing strip moves between said reels;

vacuum means for releasably retaining the removed labels at a preselected location, the articles being adapted to receive the labels from said preselected location whereby such articles are labelled; and means on said supporting structure for releasably mounting the cassette label applicator on a support.

12. A cassette label applicator as defined in claim 11 wherein said supporting structure includes a housing substantially enclosing said reels, said housing including a panel openable to expose said reels to allow said reels to be replaced.

13. A cassette label applicator as defined in claim 11 wherein said drive means includes a plurality of rotatable pins adapted to cooperate with apertures in the backing strip to drive the backing strip and an arm for driving the pins, said arm extending through said housing to the exterior thereof and being adapted to be releasably drivingly connected to the motor.

* * * * *